United States Patent [19]

DiGiulio

[11] Patent Number: 4,477,064

[45] Date of Patent: Oct. 16, 1984

[54] DEVICE FOR HOLDING WORK IN MACHINE TOOL OPERATIONS

[76] Inventor: Mario DiGiulio, Spectra Industries Corp., 405 Baily Rd., Yeadon, Pa. 19050

[21] Appl. No.: 386,700

[22] Filed: Jun. 9, 1982

[51] Int. Cl.[3] ..... B25B 1/08

[52] U.S. Cl. ..... 269/231; 269/235; 269/305

[58] Field of Search ..... 29/512, 513; 81/90 R; 269/235, 231, 900, 305

[56] References Cited

U.S. PATENT DOCUMENTS

| | | | |
|---|---|---|---|
| 724,116 | 3/1903 | Maley | 269/900 |
| 924,398 | 6/1909 | Stevens | 29/512 |
| 2,394,861 | 2/1946 | Le Tourneau | 269/231 |
| 2,430,613 | 11/1947 | Hodge | 269/231 |
| 4,157,819 | 6/1979 | Meyer | 269/231 |

FOREIGN PATENT DOCUMENTS

| | | | |
|---|---|---|---|
| 227834 | 7/1943 | Switzerland | 269/231 |

*Primary Examiner*—Robert C. Watson

*Attorney, Agent, or Firm*—Howson and Howson

[57] ABSTRACT

Several versions of a tooling plate clamp are disclosed. Each comprises a retainer pin a circular part of which extends outwardly from the face of the plate. An eccentric clamp body rotates on the circular part of the retainer pin and is held against the face of the plate, or against a spacer, by an overhanging head on the pin. The clamp body can be cylindrical to exert a lateral force on the workpiece or conical so that it exerts lateral and downward forces simultaneously. In one version, the clamp body has an edge which engages the workpiece along a narrow line of contact rather than over a wide area. The clamp body may also be a hold-down clamp with two oppositely directed helical overhanging surfaces.

1 Claim, 17 Drawing Figures

DEVICE FOR HOLDING WORK IN MACHINE TOOL OPERATIONS

BRIEF SUMMARY OF THE INVENTION

This invention relates to devices for holding workpieces in machine tool operations and particularly to improved clamping means for securing a workpiece to a tooling plate. The invention is particularly adapted, but not necessarily limited, to a jig comprising a tooling plate having a plurality of drill guides for use in a multiple drilling operation. However, it may also be used to position and hold workpieces on fixtures and other production tools and to secure workpieces and templates in fixed relationship to each other.

In a typical drilling operation, where a large number of identical workpieces are to be drilled with multiple holes, a special jig is constructed. The jig comprises a tooling plate to which appropriate drill guides are secured at the proper locations. Work locators are also provided on the tooling plate to insure that each workpiece is positioned in proper relationship to the drill guides before the drilling operation commences.

A typical drill guide is the "FLAR-A-LOCK" drill guide manufactured by Spectra Industries Corp. of 405 Baily Road, Yeadon, Pa. The "FLAR-A-LOCK" drill guide is described in my U.S. Pat. No. 2,726,559, dated Dec. 13, 1955, and the entire disclosure of the patent is here incorporated by reference. The patent also describes a typical work locator used on a tooling plate having multiple drill guides.

A tooling plate with drill guides can be used in any of several ways. In some cases, an appropriate number of work locators is provided so that the workpiece is held frictionally between work locators, with no special provision for securing the workpiece against the tooling plate. In other cases, special clamps are used to secure the workpiece to the tooling plate.

Clamps used to secure workpieces to tooling plates may take various forms. In some cases, C-clamps or toggle clamps are used. In other cases, special clamps are constructed. An example of a specially constructed clamp is one comprising a block bolted to the tooling plate and having a threaded clamping element extending through it in a direction parallel to the face of the tooling plate for urging the workpiece against one or more work locators.

While all of the foregoing schemes have been widely used, none of them is entirely satisfactory. Holding the work frictionally between work locators without the aid of clamps requires extremely accurate positioning of the work locators. In some cases special precautions must be taken to avoid relative tilting between the workpiece and the tooling plate in order to fit the workpiece into place between the work locators. C-clamps and toggle clamps cause difficulties by getting in the way of the various machine tool elements in a tooling operation or by getting in the way of the machine tool operator. Specially constructed clamps are complicated, time-consuming to assemble, and are frequently not well suited to certain kinds of workpieces, for example thin plates.

In accordance with the invention, a tooling plate is provided with a clamp body which is rotatable on a retainer pin. The retainer pin is suitably secured in a hole in the tooling plate, preferably by the flaring technique described in my U.S. Pat. No. 2,726,559. The retainer pin holds the clamp body against the face of the tooling plate tightly enough to avoid wobbling of the clamp body while allowing the clamp body to rotate about an axis perpendicular to the face of the tooling plate. The clamp body is rotated by a special wrench having two pins which extend into holes in the clamp body on opposite sides of the retainer pin.

There are two basic versions of the clamp body. In the first version, the clamp body is eccentric with respect to the retainer pin axis, and urges the workpiece laterally (in a direction parallel to the face of the tooling plate) against one or more work locators spaced from the clamp body. The clamp body can be cylindrical or conical. The cylindrical version of the clamp body merely urges the work laterally. One of the conical versions urges the work both laterally and at the same time against the tooling plate. Another conical version is designed with a narrow edge to contact the workpiece along a contact area which is very narrow, when measured in a direction perpendicular to the tooling plate. This narrow contact area serves to hold the workpiece very securely. This latter version of the clamp body can be designed for use with comparatively thin workpieces by providing the clamp body with a relatively thin frusto-conical part, the contact edge being the wide base of the frustum, and with an extension accommodating the holes which receive the pins of the special wrench for rotating the clamp body.

The second basic version of the clamp body serves as a hold-down clamp, and imparts no substantial lateral force to the work. This clamp body has at least one helical overhanging surface which engages a face of the workpiece and urges the workpiece against the tooling plate when the clamp body is rotated.

The principal object of this invention is to provide a simple and inexpensive clamping means which is both easy to use and easy to install. It is also an object of the invention to achieve very accurate alignment of the work. Still another object of the invention is to avoid interference with the operator of the machine tool or with the machine tool itself. Still another object of the invention is to provide a novel clamping means which is versatile in that the same retainer pin configuration can be used for a wide variety of types of clamp bodies. Other objects will be apparent from the following detailed description when read in conjunction with the drawings.

DETAILED DESCRIPTION

Figure 2:
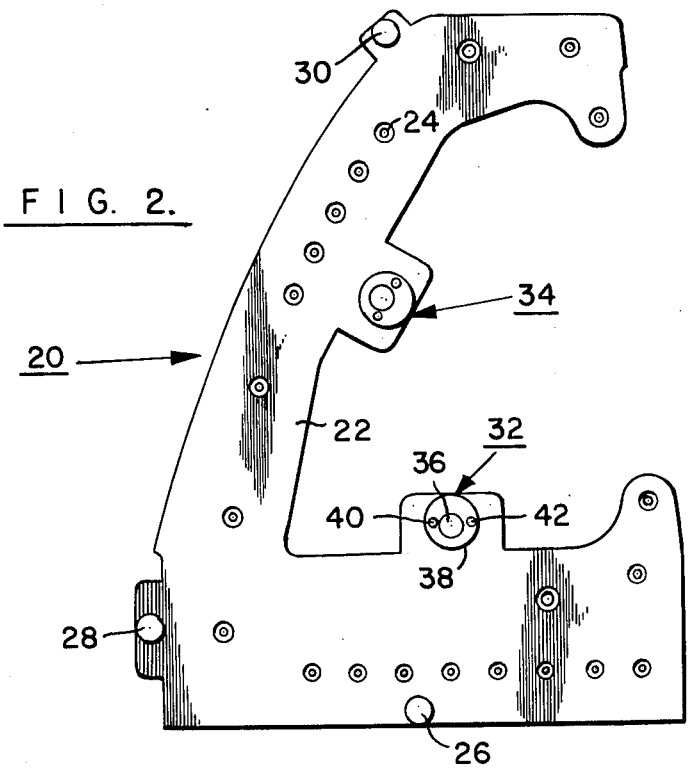
FIG. 2 is a bottom plan view of the jig of FIG. 1 with the workpiece removed.

The jig 20, as shown in FIG. 2, comprises a tooling plate 22 having a number of drill guides incorporated in it. One of the drill guides is indicated at 24. Although any available drill guide can be used, the drill guides are preferably of the type described in U.S. Pat. No. 2,726,559. These drill guides have shanks which extend into holes in the tooling plate, and which are flared outwardly to secure the drill guide firmly to the tooling plate. The body of the drill guide extends outwardly from the side of the tooling plate opposite to the side shown in FIG. 2. Work locators 26, 28 and 30 are also secured to the tooling plate and extend outwardly from the face of the tooling plate shown in FIG. 2. These work locators are cylindrical elements which are similar to the drill guides except that they have no central openings. Typically, they are secured to the tooling plate in the same way the drill guides are secured, i.e., by flaring.

On the face of the tooling plate from which the work locators project there are also provided a pair of identical clamps 32 and 34. Clamp 32 comprises a retaining pin 36 which is secured to the tooling plate by flaring or other suitable means. A clamp body 38 is arranged to rotate about the retaining pin on an axis of rotation perpendicular to the tooling plate. The retaining pin holds the clamp body snugly against the face of the tooling plate, but permits rotation of the clamp body. Holes 40 and 42 are provided on the clamp body to receive pins of a wrench which is used to rotate the clamp body.

As seen in FIG. 2, clamp body 38 is circular, but eccentric with respect to the retainer pin. That is, the center of the clamp body is spaced a short distance from the center of the retainer pin. Thus, as shown in FIG. 1, clamp 32 serves as a cam for urging a workpiece 44 against work locator 26, while clamp 34 similarly acts as a cam for urging workpiece 44 against work locators 28 and 30.

In a typical jig, a single work locator such as 26 is used on a shorter side of the workpiece, while two work locators such as 28 and 30 are used on the longer side. The locking directions of rotation of the bodies of clamps 32 and 34 are indicated in FIG. 1. When the body of clamp 34 is rotated as indicated, the clamp body urges workpiece 44 against locators 28 and 30 without tending to pull the workpiece away from locator 26. The body of clamp 32 is rotated in the direction indicated for a similar reason. Unlocking of the clamps is, of course, accomplished by rotating the clamp bodies in directions opposite to the directions indicated.

Figure 1:
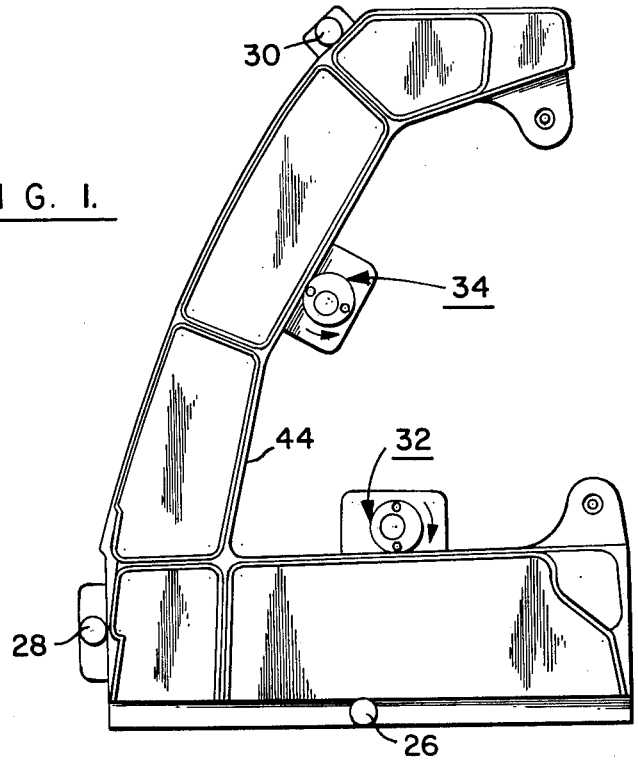
FIG. 1 is a bottom plan view showing a typical workpiece secured to a jig having improved clamping means in accordance with the invention.

While the outlines of the clamp bodies, as shown in FIGS. 1 and 2 are circular, this is not necessarily the case. The clamp body outlines can have various curvatures, so long as the clamp bodies are capable of acting as cams. Circular clamp bodies, however, are preferred because they are easy to make and because the same clamp body configuration can be used in many applications. For example, clamp bodies 32 and 34 can be identical despite the fact that they are locked by rotation in opposite directions.

Figure 3:
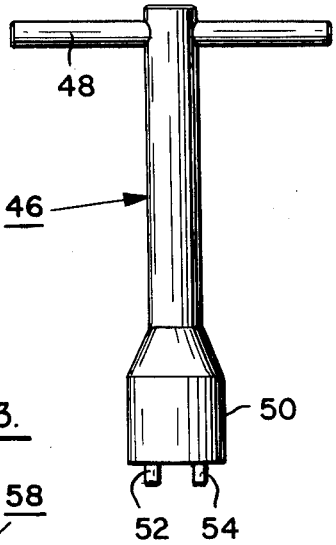
FIG. 3 is an elevational view of a wrench for tightening and loosening the clamp bodies.

Wrench 46, as shown in FIG. 3, comprises a handle 48, and a base 50 having pins 52 and 54 projecting downwardly from the base. Pins 52 and 54 are spaced by a distance equal to the spacing of holes 40 and 42 (FIG. 2) of the clamp body. Preferably, the spacing of these holes is made standard on the various clamp bodies so that the same wrench can be used for all of them.

Figure 4:
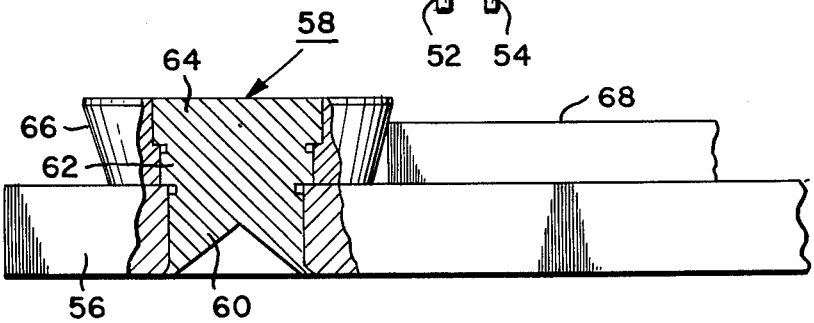
FIG. 4 is an elevational view, partly in section, showing a form of clamp comprising a frusto-conical clamp body.

The jig as shown in FIG. 4 comprises a tooling plate 56 having a retainer pin 58 tightly secured to it. Shank 60 of the retainer pin is flared as shown to prevent pin 58 from moving upwardly, and part 62 of the head of pin 58 has a shoulder which rests on the upper surface of plate 56 to prevent downwardly movement of the pin. The upper part 64 of the head of retainer pin 58 fits into a recess of a central opening of clamp body 66. Parts 62 and 64 of the head of the pin have circular cross-sections on a common axis in planes parallel to the face of the tooling plate. Clamp body 66 is rotatable about pin 58, but is held against tooling plate 56. The distance between the lower edges of parts 62 and 64 of the retainer pin is carefully controlled in the manufacturing process so that clamp body 66 can be rotated by wrench 46, but the clamp body is held firmly against the tooling plate so that it cannot wobble.

The operative part of clamp body 66 is in the form of the frustum of a right circular cone with its narrow base against the tooling plate. As the clamp body is rotated, the conical surface presses against workpiece 68, urging it to the right against one or more work locators (not shown in FIG. 4). When the workpiece is against the work locators, the conical operative surface of clamp body 66 also tends to hold workpiece 68 against the tooling plate. Thus, the clamp body of FIG. 4 serves a dual purpose in that it urges the workpiece both laterally and downwardly.

It should be noted that the assembly as shown in FIG. 4 is shown in the condition it would be in when the clamp body is rotated using the wrench. Where the tooling plate is used for drilling operations, the entire assembly of FIG. 4 will normally be turned upside down before operations are commenced.

Figure 5:
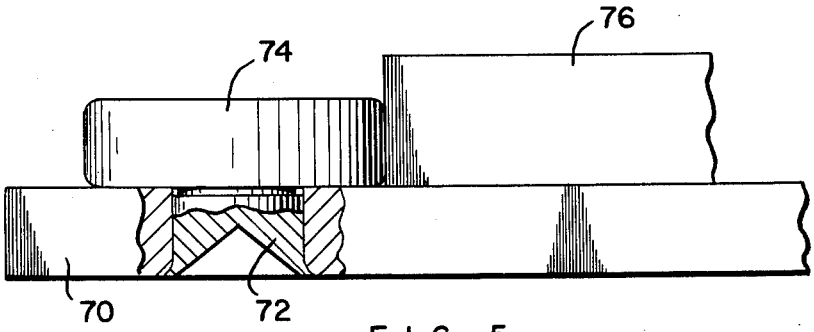
FIG. 5 is an elevational view partly in section showing a clamp comprising a cylindrical clamp body.

With thick workpieces, it may not be practical to use a conical clamp body of the type shown in FIG. 4. Instead, a cylindrical clamp body may be used. In FIG. 5, a tooling plate 70 is equipped with a retainer pin 72 and a clamp body 74 in the general form of a right circular cylinder. This cylindrical clamp body has rounded upper and lower edges, but a cylindrical operative surface which bears against workpiece 76, urging it laterally against one or more work locators (not shown). Separate means may be provided to hold the workpiece against the tooling plate, or may be omitted altogether where friction between the workpiece on the one hand and the locators and clamp bodies on the other can be relied upon to maintain the proper relationship between the jig and the workpiece.

The retainer pin 72 may be identical to retainer pin 58 of FIG. 4. Clamp body 74 is, of course, provided with a central opening (not shown) having a recessed shoulder for receiving the retainer pin.

Figure 6:
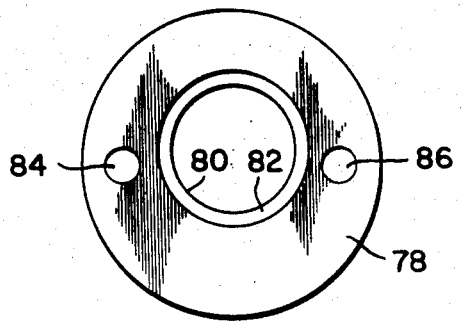
FIG. 6 is a top plan view of a typical clamp body.

FIG. 6 shows a separate clamp body 78 having a circular through hole 80 with a recessed shoulder 82. Holes 84 and 86 for the wrench are on opposite sides of the center of the periphery of clamp body 78.

Figure 7:
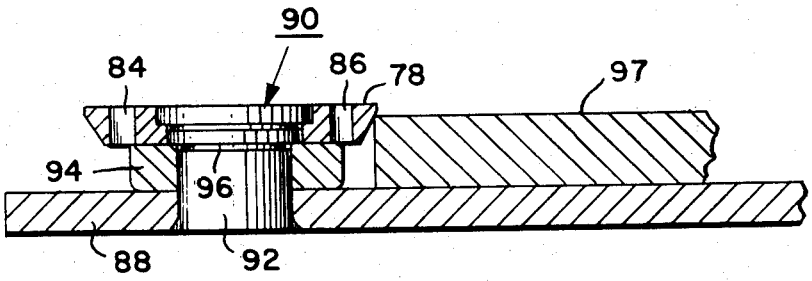
FIG. 7 is an elevational view, partly in section, showing a conical clamp body used with a spacer.
Figure 8:
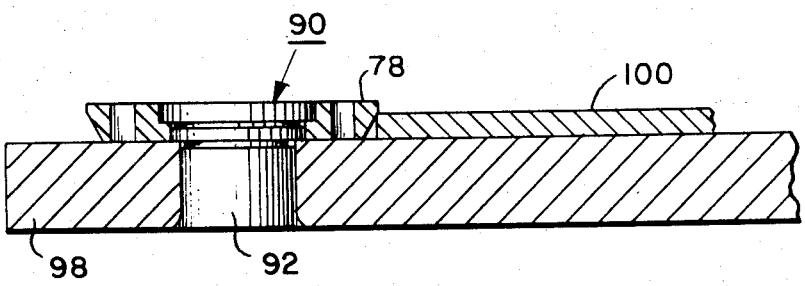
FIG. 8 is an elevational view partly in section showing the same clamp as in FIG. 7 used with a thicker tooling plate, but without a spacer.

Clamp body 78 is a frusto-conical clamp body similar to the one shown in FIG. 4. It can be used in either of two ways, as illustrated in FIGS. 7 and 8. In FIG. 7, a relatively thin tooling plate 88 is provided with a retainer pin 90 having a long shank 92. An annular spacer 94 is used between tooling plate 88 and the underside 96 of the lower part of the head of retainer pin 90. Shank 92 of the retainer pin is flared into tooling plate 88, and the entire assembly consisting of the retainer pin, tooling plate 88 and spacer 94 are held firmly together while allowing rotation of clamp body 78. Clamp body 78 engages a workpiece 97, urging it to the right, and holding it down at the same time.

In FIG. 8, the same retainer pin 90 and clamp body 78 are used with a tooling plate 98, the thickness of which is equal to the combined thickness of tooling plate 88 and spacer 94 in FIG. 7. In FIG. 8, clamp body 78 engages and holds a comparatively thin workpiece 100.

As illustrated by FIGS. 7 and 8, a spacer makes it possible to use the same frusto-conical clamp body with workpieces of different thickness. While FIGS. 7 and 8 achieve this result by using different tooling plates, it is also possible to get the same result by using retainer pins with different shank lengths.

Figure 9:
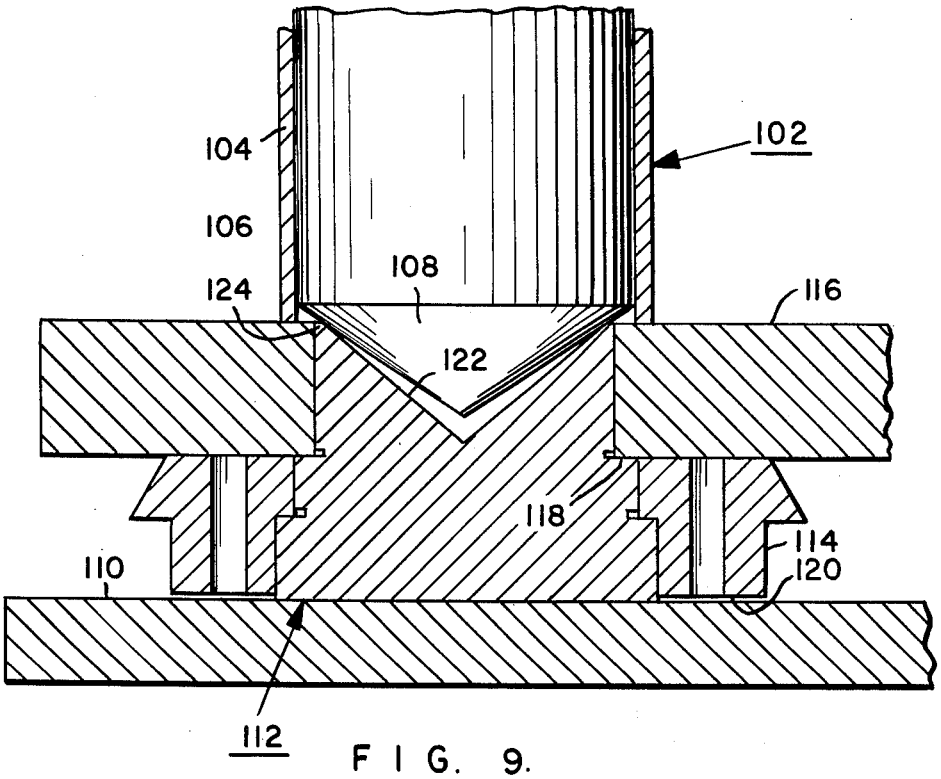
FIG. 9 is a vertical section illustrating the installation of a clamp in a tooling plate by means of a flaring tool, the clamp body being of the stepped type having a narrow contact edge.

FIG. 9 shows how flaring tool 102 is used to secure a retainer pin in place. The flaring tool comprises a guide 104 and a punch 106 which slides within the guide. Punch 106 has a cone-shaped head 108. The angle at the apex of the cone is preferably approximately 118°.

An assembly of a tooling plate, a retainer pin and a clamp body is placed upon a hard flat surface 110. The head of the retainer pin 112 is flat, and rests against surface 110. Clamp body 114 is located between surface 110 and tooling plate 116. The distance between the flat surface of the retainer pin head and retainer pin shoulder 118 is slightly greater than the vertical dimension of clamp body 114 by a few thousandths of an inch. This prevents the clamp body from interfering with the formation of a proper flare at circular edge 124 of the shank of the retainer pin. The retainer pin is provided with a conical depression 122 having an angle slightly less than the angle of punch head 108, typically 110°. When the punch 106 is struck with a hammer, edge 124 is flared outwardly, causing a slight deformation of the tooling plate at the location immediately adjacent edge 124. The flaring action permanently locks the retainer pin to the tooling plate, as shown in FIG. 10.

Figure 10:
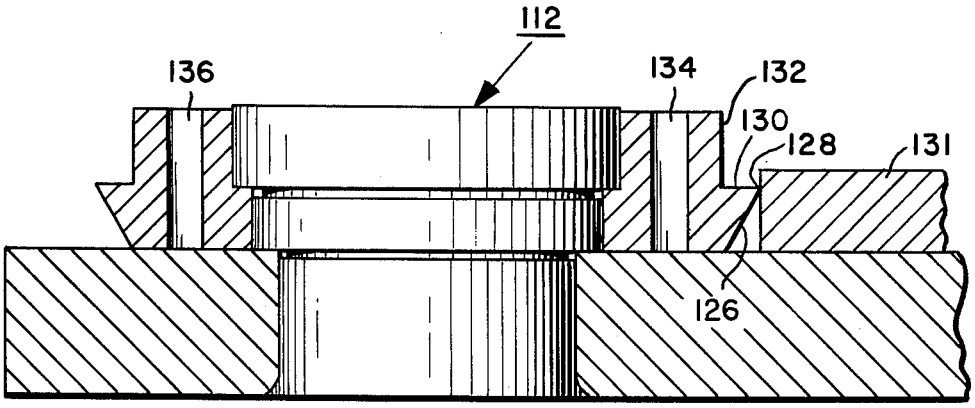
FIG. 10 is a vertical section illustrating the operation of the clamp of FIG. 9.

As shown in FIG. 10, clamp body 114 has a frusto-conical portion 126 which forms an edge 128 with horizontal shoulder 130. This edge provides a narrow area of contact with workpiece 131. This narrow area of contact enables the clamp body to exert a very high pressure against the workpiece. This high pressure contact prevents the workpiece from moving away from the tooling plate. This type of clamp body is particularly suited for relatively thin workpieces, and the clamp body can be designed to place the contact edge 128 at any desired height. Where contact edge 128 is very close to the tooling plate, the holes for the wrench may be too short to accommodate the pins of the wrench. To solve this problem, an extension 132 is provided on the clamp body. This extension makes it possible to provide holes 134 and 136 which are long enough to accommodate the pins of the wrench.

Figure 11:
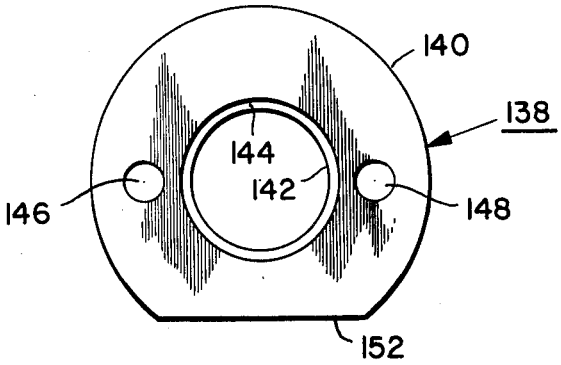
FIG. 11 is a top plan view of a clamp body of the hold-down type.

A hold-down clamp body 138 is shown in FIG. 11. This clamp body has an edge 140 in the form of a major segment of a circle, and a hole 142 which is coaxial with the circular edge. Hole 142 has a recessed shoulder 144. Holes 146 and 148 are provided on opposite sides of hole 142 for the pins of a wrench.

Figure 12:
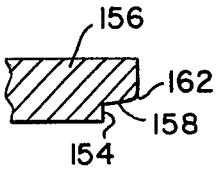
FIG. 12 is a fragmentary sectional view showing the cross-sectional configuration of a helical overhanging surface of the hold-down clamp.
Figure 13:
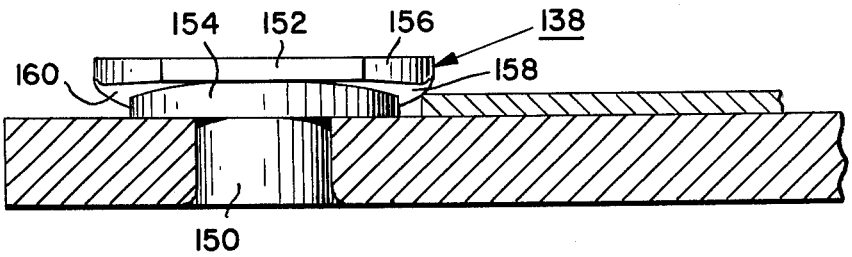
FIG. 13 is a vertical section illustrating the operation of the hold-down clamp.
Figure 14:
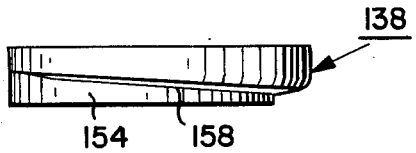
FIG. 14 is a right-hand side elevation of the clamp body of FIG. 13.
Figure 15:
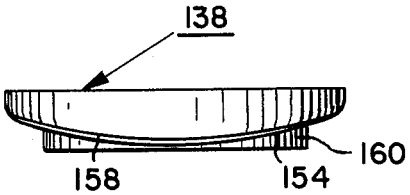
FIG. 15 is a rear elevation of the clamp body of FIG. 13.

As shown in FIG. 13, the clamp body is rotatably held on the face of a tooling plate by a retainer pin 150 which is similar to the retainer pins previously described. The clamp body 138 has a cylindrical portion 154 which is coaxial with respect to the circular periphery of the clamp body, and which is tangent to a flat face 152. As seen in FIG. 11, face 152 is a chord which extends between the ends of the circular portion of the clamp body. An overhanging portion 156, as shown in FIG. 12 has a downward face 158 which is very nearly horizontal, though it is preferably sloped at an angle of about 5° upwardly from cylindrical portion 154. A rounded edge is provided at 162 to prevent damage to the work. As shown in FIGS. 13, 14 and 15, surface 158 is helical. It progresses downwardly from the location at which it meets face 152 to a central point on the side of the clamp body opposite face 152. From there, a second helical overhanging surface progresses upwardly toward the opposite end of flat face 152.

The clamp of FIGS. 11–15 serves to hold workpieces against a tooling plate as shown in FIG. 13. However, it does not impart any appreciable lateral force to the workpiece. By using spacers similar to the one shown in FIG. 7, this clamp body can be used to hold down workpieces of various thicknesses, provided that appropriate modifications are made either in the retainer pin or in the thickness of the tooling plate.

The oppositely directed helical surfaces of clamp body 138 enable the clamp body to be tightened against the work in either direction. This is important because the more desirable of the two possible directions depends on the locations of the work locators on the tooling plate.

Figure 16:
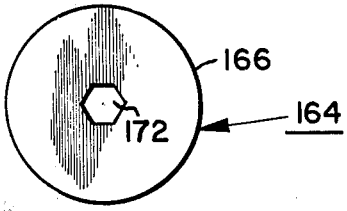
FIG. 16 is a top plan view of an alternative retaining pin.
Figure 17:
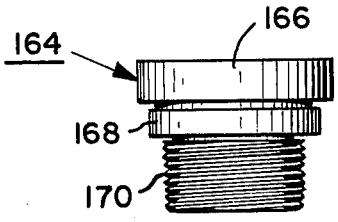
FIG. 17 is an elevational view of the alternative retaining pin.

Although it is desirable to use retainer pins which are secured to the tooling plates by flaring, it is possible to use various other forms of retainer pins. One such alternative retainer pin is shown at 164 in FIGS. 16 and 17. It comprises a head 166, an intermediate head portion 168 and a threaded shank 170. A hexagonal socket is provided in the flat face of head 166 for an Allen wrench which may be used to thread the retainer pin into a threaded hole in a tooling plate.

Another form of retainer pin can be made using the principles described in U.S. Pat. No. 4,269,550, which describes a press fit drill bushing having a toothed crown which, when pressed into a tooling plate forms chips which are packed into a groove and hold the bushing in place. This same technique can be used with a retainer pin for a clamp in accordance with the invention.

The clamp bodies of all of the foregoing examples are preferably hardened by suitable processes such as case hardening. The retainer pins are also preferably hardened, except at the location where flaring takes place.

Many modifications can be made to the size, shape and configuration of the various clamp bodies and retainer pins described above without departing from the scope of the invention as defined in the following claims.

I claim:

1. A device for holding work in machine tool operations comprising a tooling plate, at least one work locator fixed to the tooling plate and extending outwardly from a face thereof, clamp means, secured to the tooling plate and extending outwardly from said face at a location spaced from said work locator, for urging a workpiece tightly against said work locator, said clamp means comprising a retainer pin having a first part extending into a hole in said plate and fixed thereto, and a second part, having circular cross-sections on a common axis in planes parallel to said face of the plate, and extending outwardly from said face, and a clamp body having a hole fitting said second part, said clamp body being rotatable about said common axis and having camming means for contacting the workpiece and urging the workpiece against the work locator;

wherein the clamp body has a first face lying against said face of the tooling plate, a second face remote from the tooling plate and substantially parallel to said first face, and means comprising two holes for receiving the pins of a wrench for tightening the clamp means, the holes extending from said second face toward said first face, said holes being on opposite sides of the retainer pin; and wherein said second part of the retainer pin has a shoulder lying against said face of the tooling plate, said first part of the retainer pin is flared outwardly against the wall of said hole in the plate whereby said retainer pin is securely fixed to said plate, and the second part of the retainer pin extends a short distance beyond the farthest extent of said clamp body away from said face of the tooling plate;

whereby the body is prevented from interfering with the flaring of the retainer pin when the retainer pin is secured to the plate, and the retainer pin is prevented from interfering with the wrench used to tighten the clamp means.

* * * * *